US007560066B2

(12) United States Patent
Zhou et al.

(10) Patent No.: US 7,560,066 B2
(45) Date of Patent: Jul. 14, 2009

(54) METHOD OF PREPARING A BIAXIALLY TEXTURED COMPOSITE ARTICLE

(75) Inventors: Meiling Zhou, Beijing (CN); Hongli Suo, Beijing (CN); Min Liu, Beijing (CN); Yue Zhao, Beijing (CN); Dong He, Beijing (CN); Yingxiao Zhang, Beijing (CN); Lin Ma, Beijing (CN); Yaming Li, Beijing (CN); Jie Zhou, Beijing (CN); Yonghua Zhu, Beijing (CN); Shuai Ye, Beijing (CN); Lingji Ma, Beijing (CN); Zili Zhang, Beijing (CN); Tieyong Zuo, Beijing (CN)

(73) Assignee: Beijing University of Technology, Beijing (CN)

( * ) Notice: Subject to any disclaimer, the term of this patent is extended or adjusted under 35 U.S.C. 154(b) by 245 days.

(21) Appl. No.: 11/608,072

(22) Filed: Dec. 7, 2006

(65) Prior Publication Data

US 2007/0269329 A1 Nov. 22, 2007

(30) Foreign Application Priority Data

May 19, 2006 (CN) ..... 2006 1 0080877

(51) Int. Cl.
*B22F 1/00* (2006.01)

(52) U.S. Cl. ..... 419/43; 75/245

(58) Field of Classification Search ..... 505/236; 419/43; 75/245

See application file for complete search history.

(56) References Cited

U.S. PATENT DOCUMENTS 5,898,020 A 4/1999 Goyal et al.

(Continued)

OTHER PUBLICATIONS

A. Goyal, M. Paranthaman, and U. Schoop, "The rabits approach: using rolling-assisted biaxially textured substrates for high-performance YBCO superconductors.," MRS Bulletin 2004, No. 29, p. 552-561.

(Continued)

*Primary Examiner*—George Wyszomierski
*Assistant Examiner*—Weiping Zhu
(74) *Attorney, Agent, or Firm*—J.C. Patents

(57) ABSTRACT

A composite article that can be used as a substrate for coated conductors is disclosed. The composite substrate has at least three layers in which one or more inner layers of Ni—W alloys with 9 at. %-13 at. % W and two outer layers of Ni—W alloys with 3 at. %-9 at. % W. The content of W element gradually decreases from the inner layers to the outer layers. The composite substrate can be prepared using a process of designing and sintering composite ingot, rolling composite ingot and then annealing composite substrate. The composite substrate have a dominant cube texture on the outer layer of the whole substrate which have a weaker magnetism and higher strength than that of a single Ni-5 at. % W alloy substrate. the preformed composite ingot is prepared by filling and compacting the Ni—W mixed powders into a mould layer by layer according to the structure of composite substrate; in said mould, said preformed composite ingots are with the total thickness of 5-250 mm, the thickness of two outer layers being ⅔-⅔ of the total thickness. The method of the present invention can obtain the composite substrate with high mechanical strength and reduced magnetization owing to the use of the Ni alloy with high W content in the inner layers of the composite substrate.

14 Claims, 8 Drawing Sheets

U.S. PATENT DOCUMENTS

| | | | | |
|---|---|---|---|---|
| 6,180,570 | B1 | 1/2001 | Goyal | |
| 6,331,199 | B1 | 12/2001 | Goyal et al. | |
| 2006/0057014 | A1 * | 3/2006 | Oda et al. | 419/33 |

OTHER PUBLICATIONS

V. Subramanya Sarma, J. Eickemeyer, L. Schultz, B. Holzapfel, "Development of high strength and strongly cube textured Ni-4.5% W/Ni-15% Cr composite substrate for coated conductor application. ," Acta Materialia 2003, No. 51, p. 4919-4927.

V. Subramanya Sarma, B. De Boer, J. Eickemeyer, B. Holzapfel, "On the development of high strength and bi-axially textured Ni-3% W/Ni-10% Cr-1.5%A1 composite substrate for coated conductor application.," Scripta Materialia 2003, No. 48, p. 1167-1171.

B. De Boer, J. Eickemeyer, N. Reger, L. Fernanez, G.-R., J. Richter, B. Holzapfel, L. Schultz, W. Prusseit and P. Berberich., "Cube textured nickel alloy tapes as substrates for YBa2Cu3O7-x coated conductors.," Acta Materialia 2001, No. 49, p. 1421-1428.

X Y Zhou, S. Bhuiyan, S Scruggs, H. Fang and K. Salama, "Role of mechanical deformation in the texturing of coated conductor composites.," Supercond. Sci. Technol. 2003, No. 16, p. 1077-1081.

* cited by examiner

METHOD OF PREPARING A BIAXIALLY TEXTURED COMPOSITE ARTICLE

FIELD OF THE INVENTION

The present invention relates to biaxially textured, composite, metallic substrate and articles made therefrom, and more particularly to such substrate and articles made by plastic deformation processes such as rolling and subsequently recrystallizing this alloyed composite materials to form long lengths of biaxially textured sheets, and more particularly to the use of said biaxially textured sheets as templates to grow biaxially textured, epitaxial metal/alloy/ceramic layers.

BACKGROUND OF THE INVENTION

Ni—W alloy substrate is a promising choice due to its low cost and ease of forming cube texture among all the candidates of substrate materials used for YBCO coated conductors. So far long length of cube textured Ni5 at. % W substrate were successfully prepared and used widely as a substrate material for coated conductors. However, their ferromagnetism and low strength are still undesirable for extending YBCO coated conductors to a wider application. Ni alloy substrate with a W content higher than 9 at. % could ensure both required strength and acceptable magnetic properties for practical applications, but it seems too difficult to obtain a sharp cube texture in those alloys. The so called composite substrate with tri-layer structure could overcome these conflicts. J. Eickemyer, Acta Materialia, vol. 51, pp 4919-4927, 2003, has reported the fabrication of the composite substrate by inserting a high-strengthened Ni-12 at. % Cr alloy rod into a Ni-3 at. % W tube, followed by hot rolling, cold rolling as well as annealing. However, a mechanical bond between outer and inner layers is not enough strong to avoid the separation of tri-layers during the deformation. Moreover, the improvement of the mechanical and magnetic properties of the whole substrate can not still balance the drop of the quality of the cube texture in the outer layer of the composite substrate, which is possibly induced by the use of the hot rolling process. U.S. Pat. No. 6,180,570 has also reported a method of producing biaxial textured composite substrate by filling the metal tube with metal powder, followed by plastically deforming the powder-filled metal tube and recrystallization. However, only a portion of biaxial cube texture is formed in the annealed metal tapes.

OBJECTS OF THE INVENTION

Accordingly, it is an object of the present invention to provide a novel and improved method of preparing a biaxially textured composite substrate for coated conductor applications.

It is another object of the present invention to provide a novel and improved method of preparing a reinforced metallic composite substrate for coated conductor applications.

It is another object of the present invention to provide a novel and improved method of preparing a composite substrate with weak magnetism for coated conductor applications.

It is another object of the present invention to provide a novel and improved method of preparing a composite substrate with high mechanical strength and reduced magnetization owing to the use of the Ni alloy with high W content in the inner layers of the composite substrate.

Further and other objects of the present invention will become apparent from the description contained herein.

SUMMARY OF THE INVENTION

The invention relates to a method for preparing the composite substrate that can be used as substrate materials for coated conductors.

In accordance with one aspect of the present invention, a method of preparing a composite substrate including the steps of:

a) preparing the preformed composite ingot of a multilayer structure of the composite substrate, with outer layers being Ni—W alloys of low W content and inner layers being Ni—W alloys of high W content;

b)sintering the preformed composite ingot to form the metal alloy composite ingot via either powder metallurgy technique or sparking plasma sintering technique;

c) rolling the metal alloy composite ingot to form the cold-rolled composite substrate; and, d) annealing the cold-rolled composite substrate to form the biaxially textured composite substrate with highly mechanical strength and reduced magnetization.

said structure of composite substrate is designed to have at least three layers, in which one or more inner layers of Ni—W alloys with 9 at. %-13 at. % W and two outer layers of Ni—W alloys with 3 at. %-9 at. % W are provided, with the content of W element gradually decreasing from the inner layers to the outer layers;

characterized in that the preformed composite ingot is prepared by filling and compacting the Ni—W mixed powders into a mould layer by layer according to the structure of composite substrate; in said mould, said preformed composite ingots are with the total thickness of 5-250 mm, the thickness of two outer layers being ⅔-⅔ of the total thickness.

The method claimed in the present invention can avoid inter-layers separation of the composite substrate during the heavy rolling process owing to a chemical bond and a gradient distribution of W element content in the cross section of the composite ingot.

The method of the present invention can obtain the composite substrate with sharp cube textures owing to the use of the Ni alloy with low W content in the outer layers of the composite substrate and the avoidance of a hot rolling process.

The method of the present invention can obtain the composite substrate with high mechanical strength and reduced magnetization owing to the use of the Ni alloy with high W content in the inner layers of the composite substrate.

DETAILED DESCRIPTION OF THE INVENTION

A composite substrate article having at least three layers in which one or more inner layers (IL) of Ni—W alloys with 9 at. %-13 at. % W and two outer layers (OL) of Ni—W alloys with 3 at. %-9 at. % W are provided. The content of W element gradually decreases from the inner layers to the outer layers.

Figure 1:
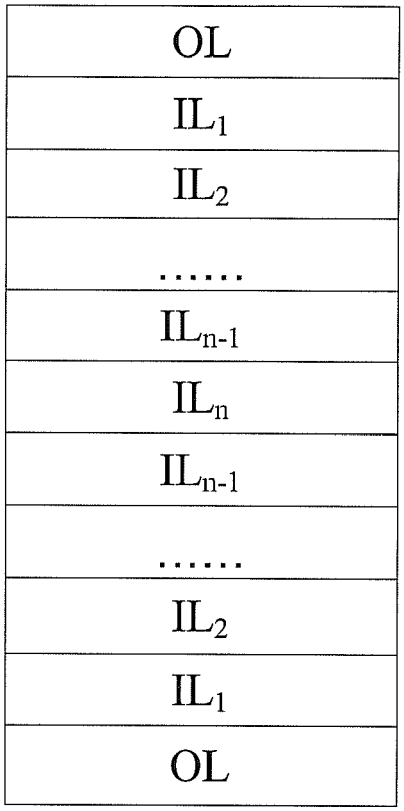
FIG. 1 shows a schematic illustration of the composite substrate's structure.

A method for preparing a composite substrate including the steps of:

a) designing the structure of composite substrate, as shown in FIG. 1, outer layers being Ni—W alloys with low W content and inner layers being Ni—W alloys with high W content, the content of W element gradually decreasing from the inner layers to the outer layers. In view of the geometry of the composite architecture, each layer is centro-symmetric;

b) filling and compacting Ni—W mixed powders into a mould layer by layer according to the sequence of $OL/IL_1/IL_2/(\ldots)/IL_{n-1}/IL_n/IL_{n-1}/(\ldots)/IL_2/IL_1/OL$ to form the preformed composite ingot with the total thickness of 5-250 mm, the thickness of the outer layer being ⅔-⅔ of the total thickness, the thickness of each inner layer being same;

c)sintering the preformed composite ingot in a flowing gas included $H_2$ in the range of 900° C. to 1350° C. for 5-10 h using powder metallurgy technique or in the range of 800° C. to 1100° C. for 20-60 minutes using sparking plasma sintering technique in vacuum;

d) rolling a metal alloy preformed composite ingot to form cold-rolled composite substrate to a thickness of 60-200 μm with per pass reduction of 5-20% and a total reduction of more than 90%; and, e) either annealing the cold-rolled composite substrate in a flowing gas included $H_2$ at the temperatures in the range of 600° C. to 800° C. for 15-120 minutes, followed by annealing at the temperatures in the range of 900° C. to 1350° C. for 30-180 minutes or only annealing at the temperatures in the range of 900° C. to 1350° C. for 30-180 minutes to form biaxially textured composite substrate with high mechanical strength and reduced magnetization.

Figure 2A:
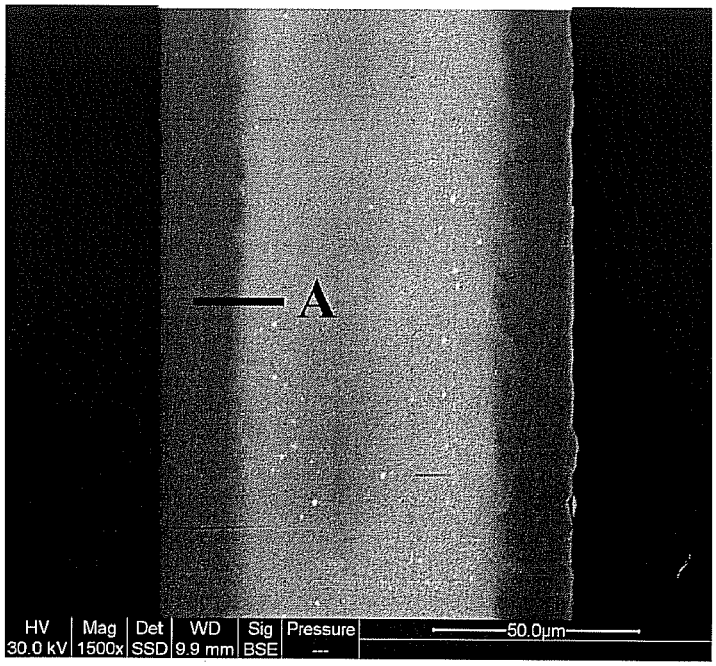
FIG. 2*a* shows a back scattering electron image (BSE) for the cross section of a Ni5W/Ni10W/Ni5W composite substrate.
Figure 2B:
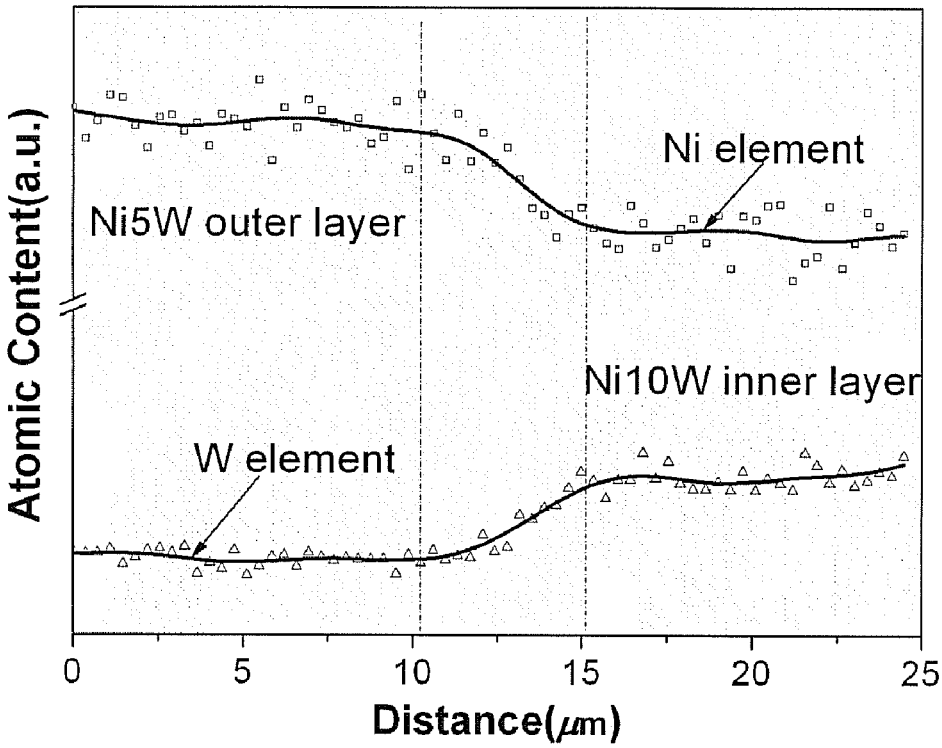
FIG. 2*b* shows an energy dispersive spectroscopy (EDS) line scanning of the distribution of W and Ni elements on the line A marked in the FIG. 2*a*.

FIG. 2*a* shows a back scattering electron image of the cross section of a composite substrate with three layers. A good connectivity and a clear boundary between the inner layer and the outer layer can be observed. The key of the process is to press multilayer powder together and to sinter it as a chemically joined alloy ingot with a metallurgy bond, thus avoiding inter-layers separation of composite substrate during the heavy rolling process. FIG. 2*b* shows an energy dispersive spectroscopy line scanning of the distribution of W and Ni elements on the line A in the FIG. 2*a*. It was found that the Ni and W elements were distributed gradually in the interfaces between outer and inner layers, which is due to the dynamic diffusion of W and Ni in the interfaces during sintering. A thin diffusion layer located in the interface between the outer and inner layers plays as a stress released layer. Thus, the shear stress induced by the different hardness of the outer and inner layers could be released continuously so as to avoid the formation of the sausage cracks on the surface of the composite substrate during the deformation.

FIGS. 3-7 show 111 pole figures for composite substrate. The pole figures indicate only four peaks consistent with a well-developed {100}<100> biaxial cube texture. FIG. 9-13 show ϕ scans of the (111) reflection, with ϕ varying from 0° to 360°. The FWHM values as determined by fitting a Gaussian curve to one of the peaks are about 15° or less, which also indicate the in-plane textures of the grains in the samples. Owing to the lower W content, sharp biaxial cube textures can be easily obtained in the outer layers of the Ni—W alloy composite substrate via recrystallization annealing.

The yield strength values of the composite substrate are showed in table 1 and 2. As shown in table 1 and 2, the mechanical strength is dramatically increased when compared to that of pure Ni and Ni5W substrate. The peak yield strength reaches 405 MPa, being that of pure Ni and Ni5W substrate by a factor of about 10.1 and 2.7. The Ni—W alloys with high W content and strong strength are used as inner layers, thus leading to the increase of the mechanical strength of the whole composite substrate.

Figure 8:
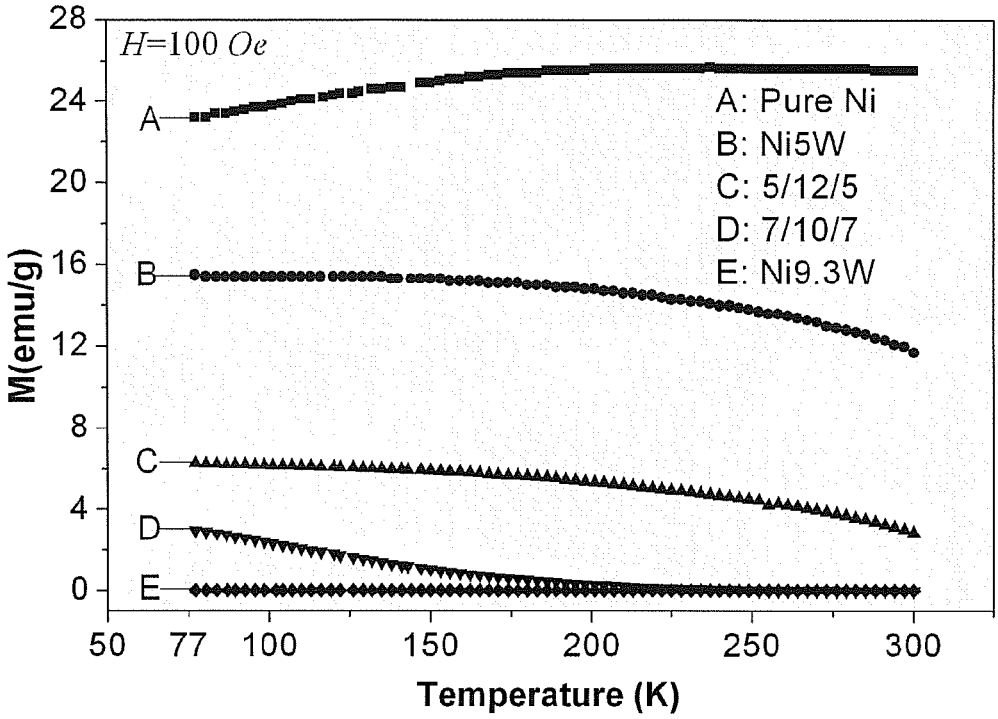
FIG. 8 shows curves of magnetization vs temperature for the pure Ni, Ni5W, Ni9W as well as the Ni5W/Ni12W/Ni5W and Ni7W/Ni10W/Ni7W composite substrate.
Figure 14:
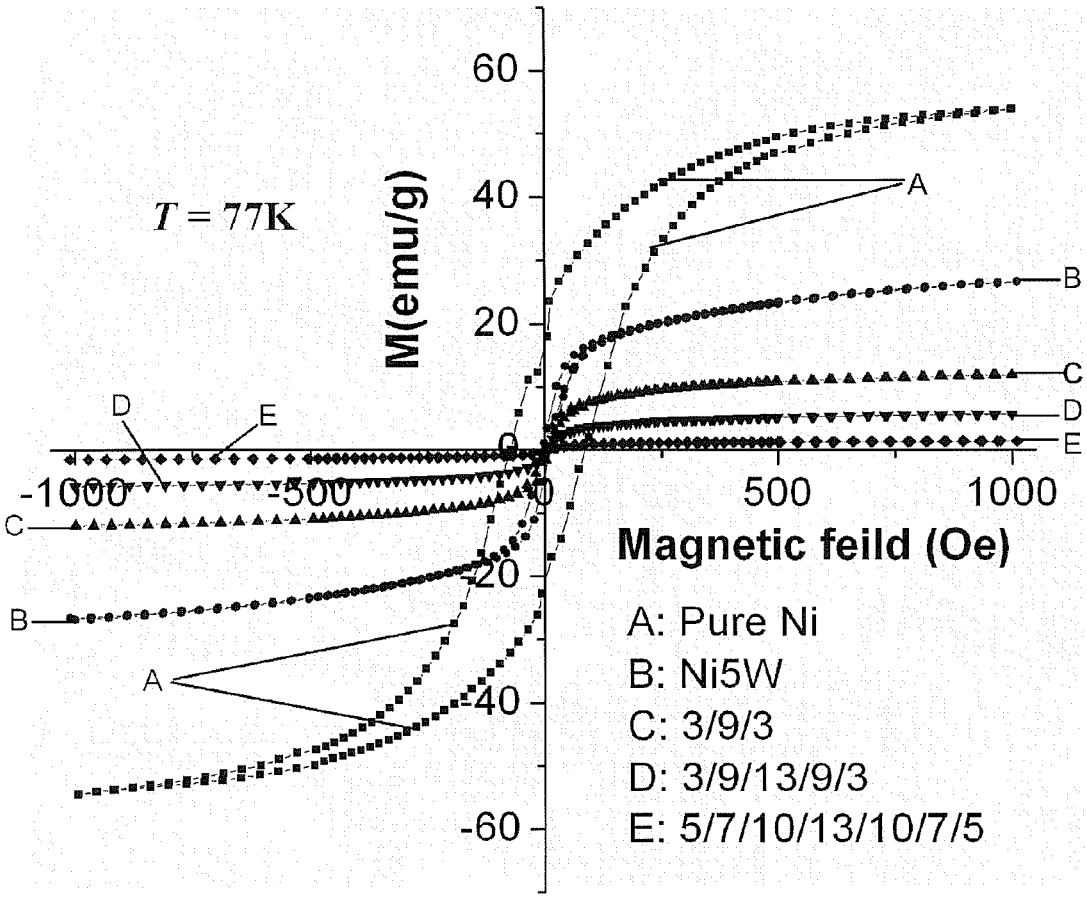
FIG. 14 shows hysteresis loops at 77K for the pure Ni, Ni5W and Ni3W/Ni9W/Ni9W, Ni3W/Ni9W/Ni13W/Ni9W/Ni3W as well as Ni5W/Ni7W/Ni10W/Ni13W/Ni10W/Ni7W/Ni5W composite substrate.

FIG. 8 and FIG. 14 show the curves of the mass magnetization vs the temperature and hysteresis loops at 77K, respectively, for the composite substrate made by the method claimed in this invention. It is shown that the magnetization is remarkably decreased in the composite substrate and the saturation magnetizations are only 14% and 20%, respectively, of the pure Ni and Ni5W substrate at 77K. It was believed that the inner layers of Ni—W alloys with non-magnetism reduce the magnetism of the whole composite substrate.

Examples from I to V are the composite substrate with three layers which have been disclosed at early time in the Chinese patent application 200610080877.1.

EXAMPLE I

Milling B powder (Ni-5 at. % W) and A powder (Ni-10 at. % W), respectively; filling and compacting A powder and B powder into a mould layer by layer according to the sequence of B-A-B to form the preformed composite ingot; putting this mould into a spark plasma sintering equipment (SPS-3.20-MV type equipment, made in Japan) and keeping it to be sintered at 850° C. for 60 min in vacuum; cold-rolling the sintered composite ingot to a 100 μm of the thickness with a deformation of 5-13% per reduction and the total reduction being larger than 95%; annealing the cold-rolled substrate at 700° C. for 30 min in a mixture of Ar and $H_2$ protected atmosphere, followed by the second step annealing at temperature of 1100° C. for 60 min, obtaining the final Ni alloy composite substrate.

Figure 3:
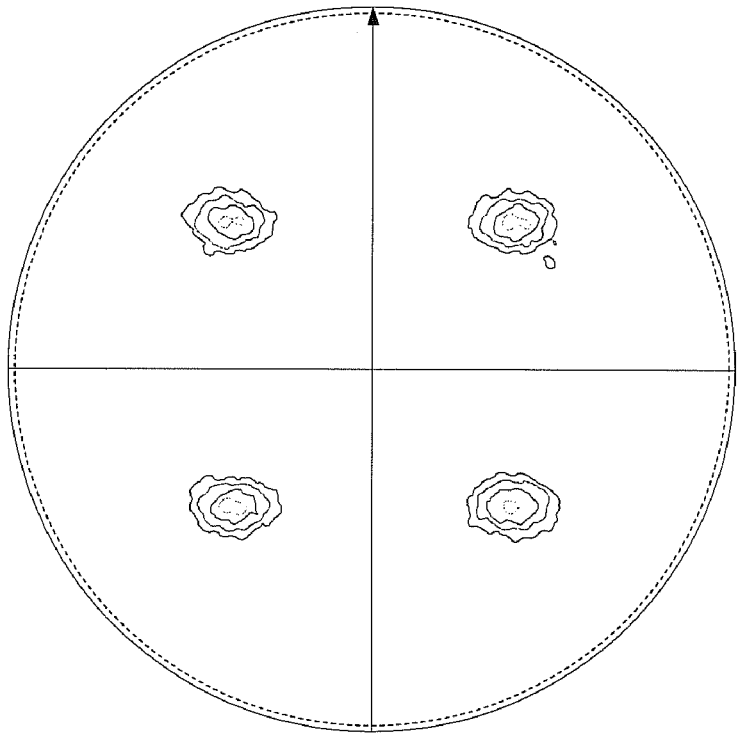
FIG. 3 shows a 111 pole figure for the outer layer of a Ni5W/Ni10W/Ni5W composite substrate.

FIG. 3 illustrates the (111) pole figure of the substrate surface; the yield strength of the composite substrate is 190 MPa at room temperature, being a factor of 4.8 and 1.3 compared to that of the pure Ni and Ni5W substrate, respectively.

EXAMPLE II

Milling B powder (Ni-7 at. % W) and A powder (Ni-10 at. % W), respectively; filling and compacting A powder and B powder into a mould layer by layer according to the sequence of B-A-B to form the preformed composite ingot; compacting it by a traditional powder metallurgy cold isostatic press with a pressure in the range of 150 MPa, sintering the composite ingot homogeneously at 1000° C. for 5 h in a mixture of Ar and $H_2$ protected atmosphere; cold-rolling the sintered composite ingot to 200 μm of the thickness with a per-reduction of 5-20%, and the total reduction being larger than 95%; annealing the cold-rolled substrate at 1000° C. for 2 h, obtained the final Ni based alloys composite substrate.

Figure 4:
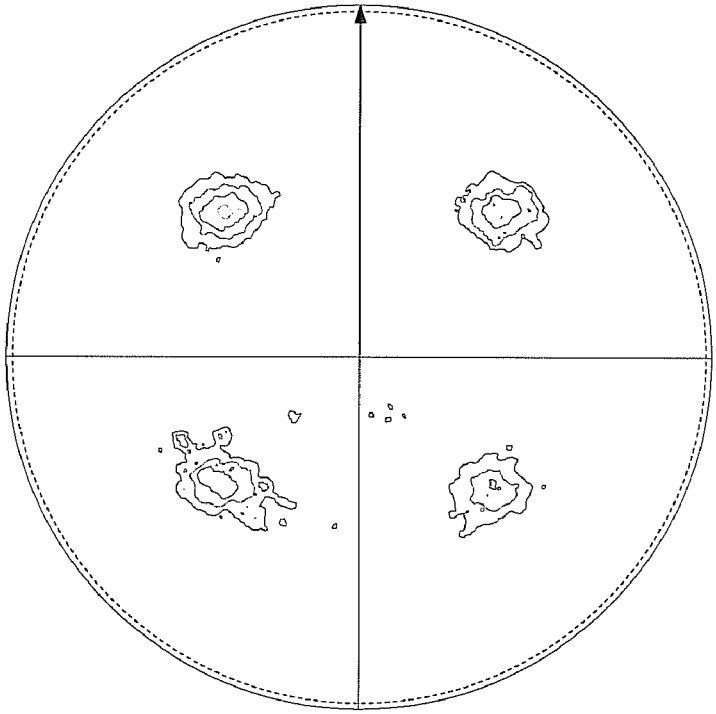
FIG. 4 shows a 111 pole figure for the outer layer of a Ni7W/Ni10W/Ni7W composite substrate.

FIG. 4 shows the (111) pole figure of the composite substrate surface; the mechanical strength is also dramatically increased; the yield strength of the substrate is 220 MPa at room temperature, being a factor of 5.5 and 1.5 compared to that of the pure Ni and Ni5W substrate, respectively.

EXAMPLE III

Milling B powder (Ni-3 at. % W) and A powder (Ni-9.3 at. % W), respectively; filling and compacting A powder and B powder into a mould layer by layer according to the sequence of B-A-B to form the preformed composite ingot; compacting it by a traditional powder metallurgy cold isostatic press with a pressure in the range of 300 MPa, sintering the composite ingot homogeneously at 1200° C. for 8 h in a mixture of Ar and $H_2$ protected atmosphere; cold-rolling the sintered composite ingot to a 180 μm of the thickness with a per-reduction of 5-20%, and the total reduction being larger than 95%; annealing the cold-rolled substrate at 1200° C. for 0.5 h in vacuum ($10^{-6}$ Pa), obtained the final Ni based alloys composite substrate.

Figure 5:
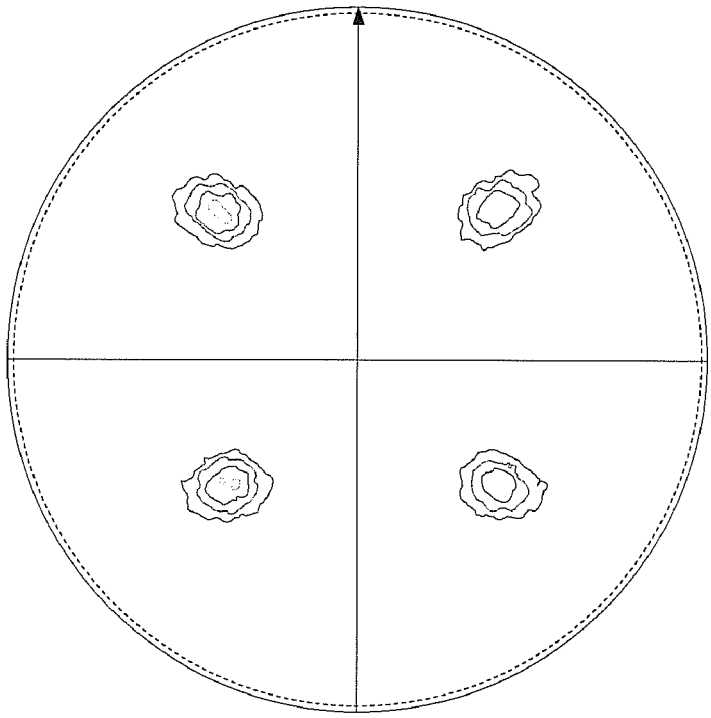
FIG. 5 shows a 111 pole figure for the outer layer of a Ni3W/Ni9. 3W/Ni3W composite substrate.

FIG. 5 shows the (111) pole figure of the substrate surface; the mechanical strength is also dramatically increased; the yield strength of the substrate is 175 MPa at room temperature, being a factor of 4.4 and 1.2 compared to that of the pure Ni and Ni5W substrate, respectively.

EXAMPLE IV

Milling B powder (Ni-5 at. % W) and A powder (Ni-12 at. % W), respectively; filling and compacting A powder and B powder into a mould layer by layer according to the sequence of B-A-B to form the preformed composite ingot; compacting it by a traditional powder metallurgy cold isostatic press with a pressure in the range of 200 MPa, sintering the composite ingot homogeneously at 1300° C. for 10 h in a mixture of Ar and $H_2$ protected atmosphere; cold-rolling the sintered composite ingot to a 60 μm of the thickness with a per-reduction of 5-20%, and the total reduction being larger than 95%; annealing the cold-rolled substrate at 700° C. for 60 min, followed by annealing at 1100° C. for 30 min, obtained the final Ni based alloys composite substrate.

Figure 6:
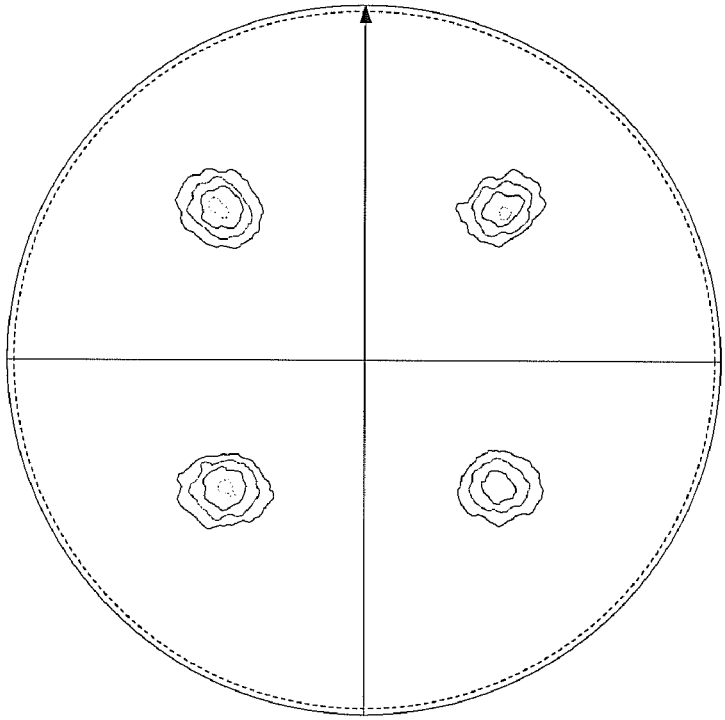
FIG. 6 shows a 111 pole figure for the outer layer of a Ni5W/Ni12W/Ni5W composite substrate.

FIG. 6 shows the (111) pole figure of the substrate surface; the mechanical strength is dramatically increased, too; the yield strength of the substrate is 275 MPa at room temperature, being that of pure Ni and Ni5W substrate by a factor of 6.9 and 1.8. FIG. 8 shows the curve of magnetic strength vs temperature of composite substrate. From the figure we can see the magnetic property of the sample is noticeably decreased compared to pure Ni and Ni5W substrate. At 77K, the magnetization of the composite substrate is about 50% and 70% of pure Ni and Ni5W substrate.

EXAMPLE V

Milling B powder (Ni-7 at. % W) and A powder (Ni-10 at. % W), respectively; filling and compacting A powder and B powder into a mould layer by layer according to the sequence of B-A-B to form the preformed composite ingot; using SPS technique, putting the mould into a spark plasma sintering equipment (named SPS-3.20-MV type SPS equipment, made in Japan) keeping it to be sintered at 1000° C. for 20 min with pressing in vacuum; cold-rolling the sintered composite ingot to a 150 μm of the thickness with a per-reduction of 8-18% and the total reduction being larger than 95%; annealing the cold-rolled substrate at 1300° C. for 1 h, obtaining the final Ni based alloys composite substrate.

Figure 7:
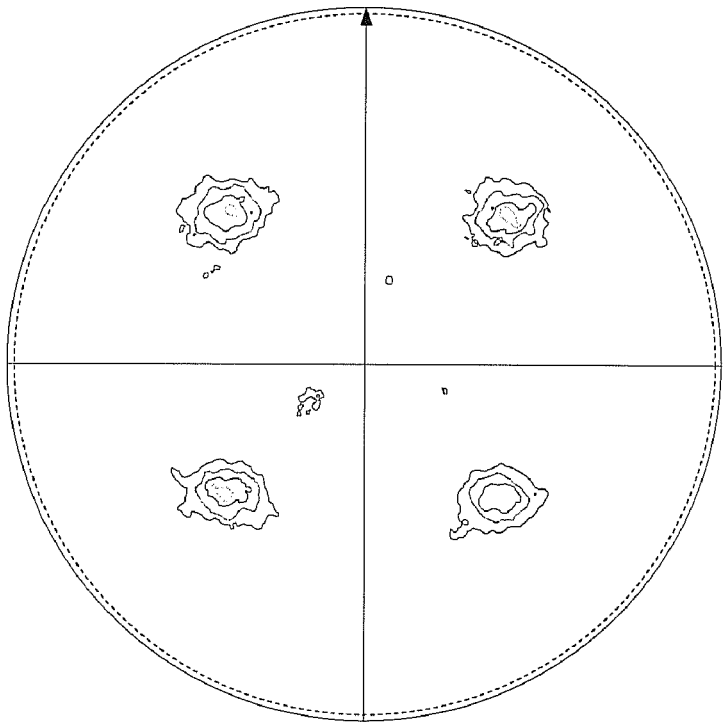
FIG. 7 shows a 111 pole figure for the outer layer of a Ni7W/Ni10W/Ni7W composite substrate.

FIG. 7 shows the (111) pole figure of the composite substrate surface; the mechanical strength is dramatically increased, too; the yield strength of the substrate is 260 MPa at room temperature, being a factor of 6.5 and 1.7 compared to that of the pure Ni and Ni5W substrate, respectively. FIG. 8 shows the mass magnetization curve of magnetic strength vs temperature of the composite substrate. The magnetism of the composite substrate is noticeably decreased compared to that the pure Ni and Ni5W substrate. At 77K, the saturation magnetization of the composite substrate is about 14% and 20% of the pure Ni and Ni5W substrate, respectively.

TABLE 1

Summary of the yield strength values of the composite substrate

| | EXAMPLE | | | | |
|---|---|---|---|---|---|
| | I | II | III | IV | V |
| Yield strength of the composite substrate at room temperature/MPa | 190 | 220 | 175 | 275 | 260 |
| Multiple when compared with the pure Ni substrate | 4.8 | 5.5 | 4.4 | 6.9 | 6.5 |
| Multiple when compared with the pure Ni5W substrate | 1.3 | 1.5 | 1.2 | 1.8 | 1.7 |
| Yield strength of the pure Ni substrate/MPa | 40 | | | | |
| Yield strength of the pure Ni5W substrate/MPa | 150 | | | | |

Examples hereafter from VI to X will report on the composite substrate with three or more than three layers and the outer layer of the composite substrate have a larger range of the W content from 3 at. %-9 at. %. Meanwhile the strength and magnetism of the composite substrate have been further improved.

EXAMPLE VI

Filling and compacting the Ni—W mixed powders into a mould layer by layer according to the sequence of Ni3W/Ni9W/Ni3W to form a preformed composite ingot with the total thickness of 40 mm, the thickness of the outer layer being ⅓ of the total thickness, the thickness of each inter layer being same; compacting and sintering preformed composite ingot using a sparking plasma sintering technique at a temperature of 800° C. for 60 minutes; rolling a metal alloy composite ingot to form cold-rolled composite substrate and annealing cold-rolled composite substrate at a temperature of 1200° C. for 30 minutes in a vacuum of $10^{-6}$ Pa. A biaxially textured composite substrate with high mechanical strength and reduced magnetization is obtained.

Figure 9:
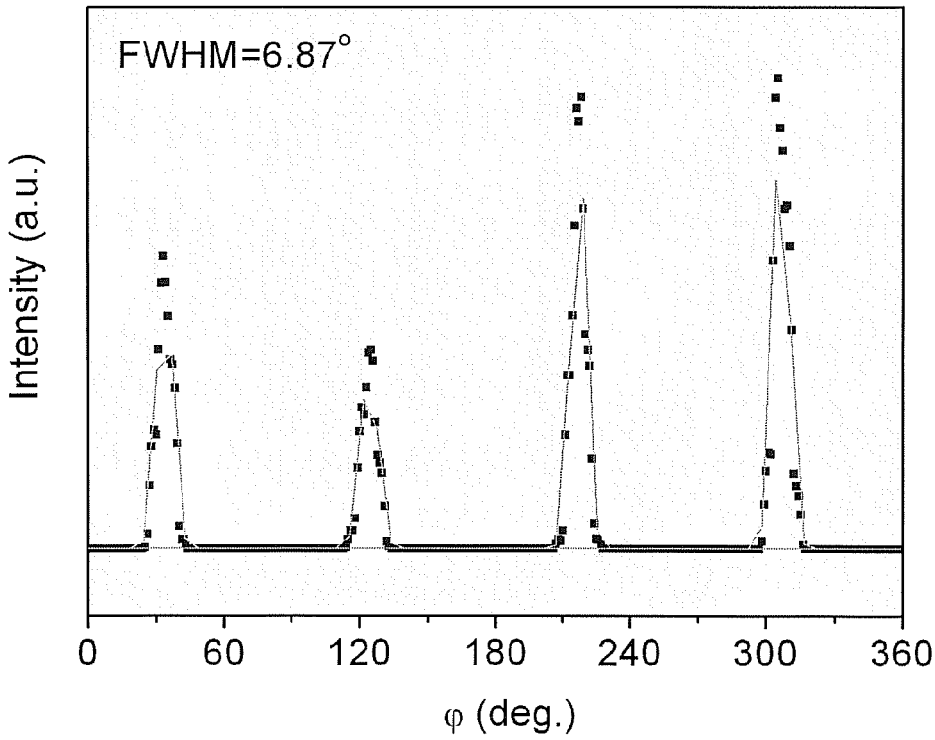
FIG. 9 shows a ϕ scan of the 111 reflection for the outer layer of a Ni3W/Ni9W/Ni3W composite substrate.

FIG. 9 shows a $\phi$ scan of the (111) reflection, with $\phi$ varying from 0° to 360°, for the outer layer of a Ni3W/Ni9W/Ni3W composite substrate. The FWHM of the $\phi$-scan, as determined by fitting a Gaussian curve to one of the peaks is 6.87°. The FWHM of the peaks in this scan is indicative of the in-plane texture of the grains in the sample. The composite substrate exhibits high yield strength in which the value of $\sigma_{0.2}$ is 181 MPa, being a factor of about 4.5 and 1.2 compared to that of pure Ni and Ni5W tapes, respectively. FIG. 14 shows the hysteresis loops vs the field at 77K in this substrate. Compared to Ni5W substrate, the magnetism of the sample are dramatically decreased.

EXAMPLE VII

Filling and compacting the Ni—W mixed powders into a mould layer by layer according to the sequence of Ni9W/Ni13W/Ni9W to form preformed composite ingot with the total thickness of 10 mm, the thickness of the outer layer being ⅓ of the total thickness, the thickness of each inter layer being same; compacting and sintering preformed composite ingot using powder metallurgy technique at a temperature of 1350° C. for 5 hours; rolling a metal alloy composite ingot to form cold-rolled composite substrate and annealing cold-rolled composite substrate at a 700° C. for 90 minutes, followed by annealing at a temperature of 1300° C. for 90 minutes in flowing 4% $H_2$ in Ar. A biaxially textured composite substrate with high mechanical strength and reduced magnetization is obtained.

Figure 10:
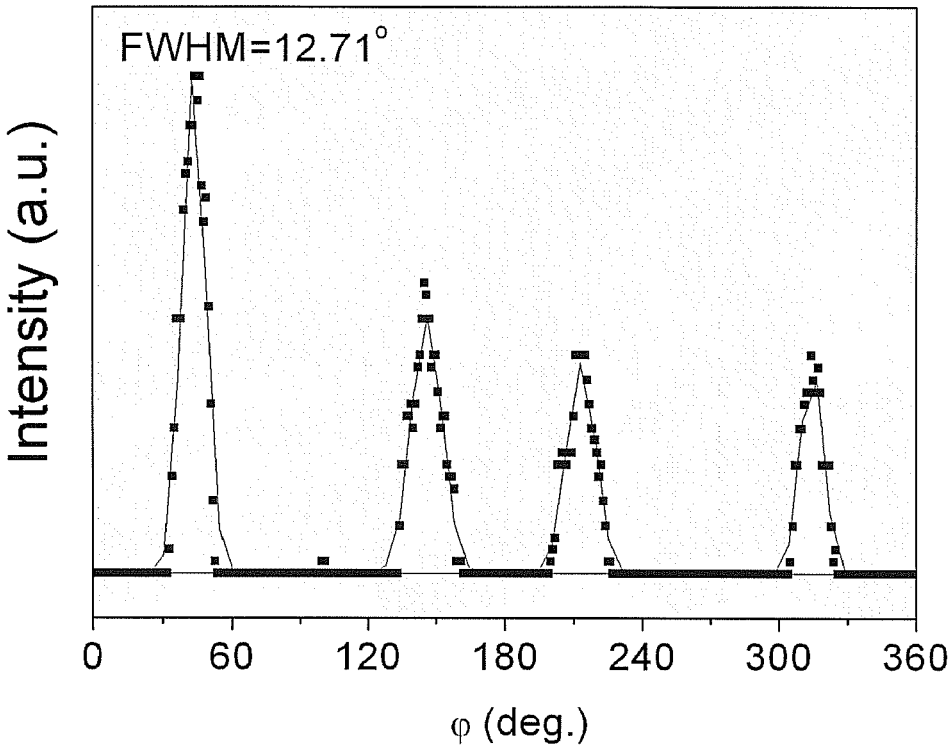
FIG. 10 shows a ϕ scan of the 111 reflection for the outer layer of a Ni9W/Ni13W/Ni9W composite substrate.

FIG. 10 shows a ϕ scan of the (111) reflection, with ϕ varying from 0° to 360°, for the outer layer of a Ni9W/Ni13W/Ni9W composite substrate. The FWHM of the ϕ-scan, as determined by fitting a Gaussian curve to one of the peaks is 12.71°. The FWHM of the peaks in this scan is indicative of the in-plane texture of the grains in the sample. The composite substrate exhibits high yield strength in which the value of $\sigma_{0.2}$ is 405 MPa, being a factor of about 10.1 and 2.7 compared to that of pure Ni and Ni5W tapes, respectively.

EXAMPLE VIII

Filling and compacting the Ni—W mixed powders into a mould layer by layer according to the sequence of Ni3W/Ni9W/Ni13W/Ni9W/Ni3W to form preformed composite ingot with the total thickness of 20 mm, the thickness of the outer layer being ⅖ of the total thickness, the thickness of each inter layer being same; compacting and sintering preformed composite ingot using powder metallurgy technique at a temperature of 1200° C. for 8 hours; rolling a metal alloy composite ingot to form cold-rolled composite substrate and annealing cold-rolled composite substrate at a temperature of 700° C. for 20 minutes, followed by annealing at a temperature of 1200° C. for 180 minutes in flowing 4% $H_2$ in Ar. A biaxially textured composite substrate with high mechanical strength and reduced magnetization is obtained.

Figure 11:
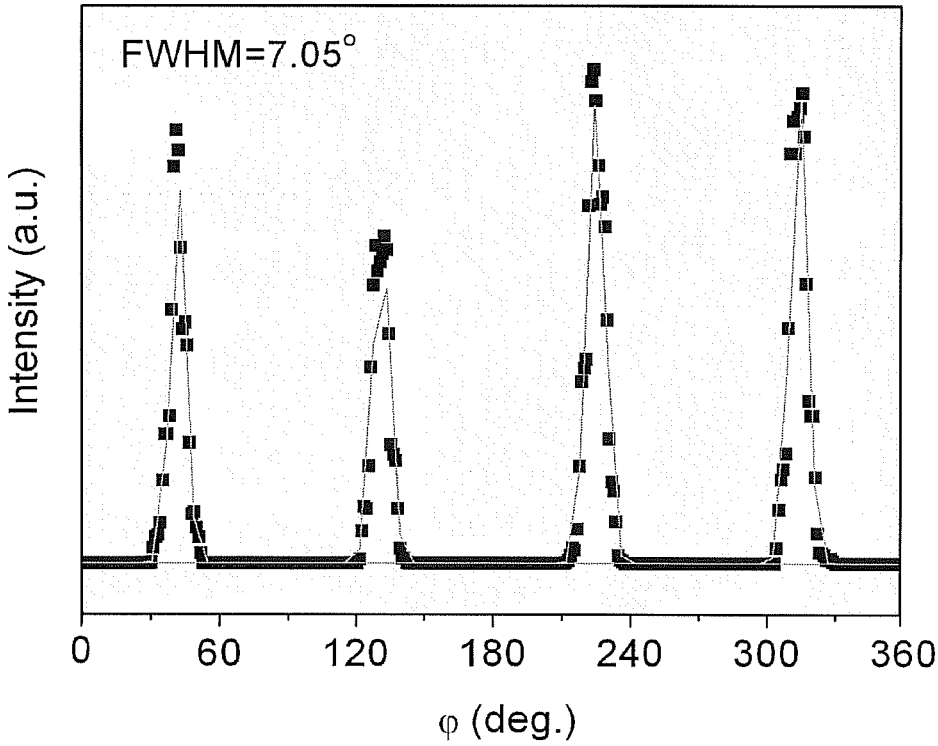
FIG. 11 shows a ϕ scan of the 111 reflection for the outer layer of a Ni3W/Ni9W/Ni13W/Ni9W/Ni3W composite substrate.

FIG. 11 shows a ϕ scan of the (111) reflection, with ϕ varying from 0° to 360°, for the outer layer of a Ni3W/Ni9W/Ni13W/Ni9W/Ni3W composite substrate. The FWHM of the ϕ-scan, as determined by fitting a Gaussian curve to one of the peaks is 7.05°. The FWHM of the peaks in this scan is indicative of the in-plane texture of the grains in the sample. The composite substrate exhibits high yield strength in which the value of $\sigma_{0.2}$ is 285 MPa, being a factor of about 7.1 and 1.9 than that of pure Ni and Ni5W tapes, respectively. FIG. 14 shows the hysteresis loops vs the field at 77K in the sample. Compared to Ni5W substrate, the magnetism of the sample are dramatically decreased.

EXAMPLE IX

Filling and compacting the Ni—W mixed powders into a mould layer by layer according to the sequence of Ni5W/Ni7W/Ni10W/Ni13W/Ni10W/Ni7W/Ni5W to form preformed composite ingot with the total thickness of 30 mm, the thickness of the outer layer being ⅔ of the total thickness, the thickness of each inter layer being same; compacting and sintering preformed composite ingot using sparking plasma sintering technique at a temperature of 1100° C. for 20 minutes; rolling a metal alloy preformed composite ingot to form cold-rolled composite substrate and annealing cold-rolled composite substrate at a temperature of 1350° C. for 120 minutes in flowing 4% $H_2$ in Ar. A biaxially textured composite substrate with high mechanical strength and reduced magnetization is obtained.

Figure 12:
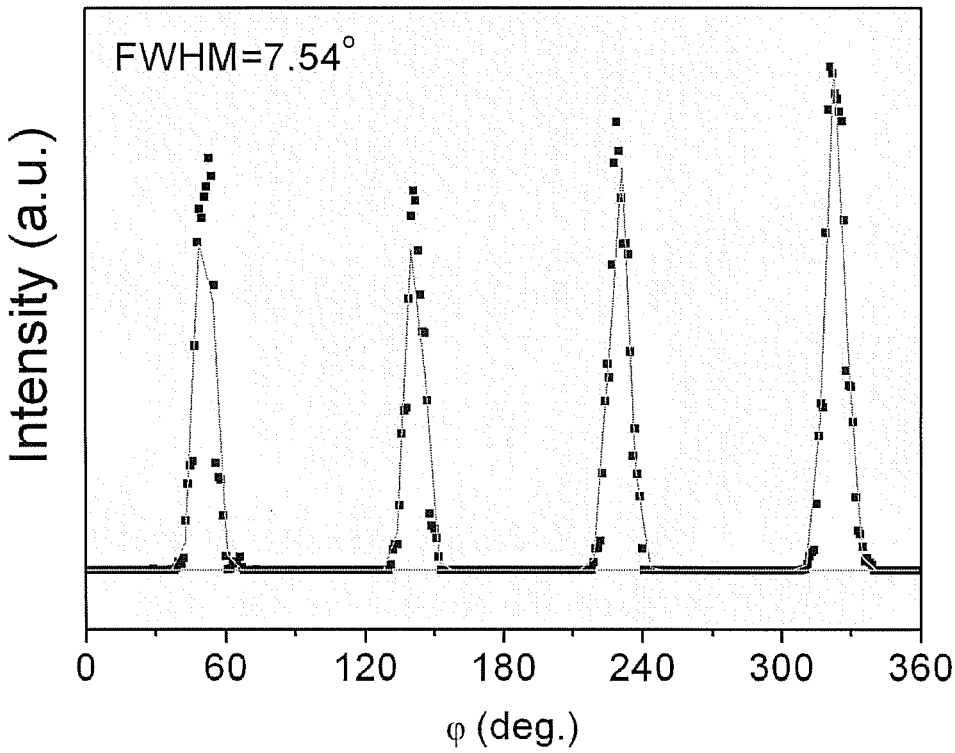
FIG. 12 shows a ϕ scan of the 111 reflection for the outer layer of a Ni5W/Ni7W/Ni10W/Ni13W/Ni10W/Ni7W/Ni5W composite substrate.

FIG. 12 shows a ϕ scan of the (111) reflection, with ϕ varying from 0° to 360°, for the outer layer of a Ni5W/Ni7W/Ni10W/Ni13W/Ni10W/Ni7W/Ni5W composite substrate. The FWHM of the ϕ-scan, as determined by fitting a Gaussian curve to one of the peaks is 7.54°. The FWHM of the peaks in this scan is indicative of the in-plane texture of the grains in the sample. The composite substrate exhibits high yield strength in which the value of $\sigma_{0.2}$ is 338 MPa, being a factor of about 8.4 and 2.3 compared to that of pure Ni and Ni5W tapes, respectively. FIG. 14 shows the hysteresis loops vs the field at 77K in the sample. Compared to Ni5W substrate, the magnetism of the sample are dramatically decreased.

EXAMPLE X

Filling and compacting the Ni—W mixed powders into a mould layer by layer according to the sequence of Ni7W/Ni10W/Ni13W/Ni10W/Ni7W to form preformed composite ingot with the total thickness of 30 mm, the thickness of the outer layer being ⅖ of the total thickness, the thickness of each inter layer being same; compacting and sintering preformed composite ingot using powder metallurgy technique at a temperature of 1300° C. for 6 hours; rolling a metal alloy preformed composite ingot to form cold-rolled composite substrate and annealing cold-rolled composite substrate at a 700° C. for 90 minutes, followed by annealing at a temperature of 1300° C. for 120 minutes in flowing 4% $H_2$ in Ar. A biaxially textured composite substrate with high mechanical strength and reduced magnetization is obtained.

Figure 13:
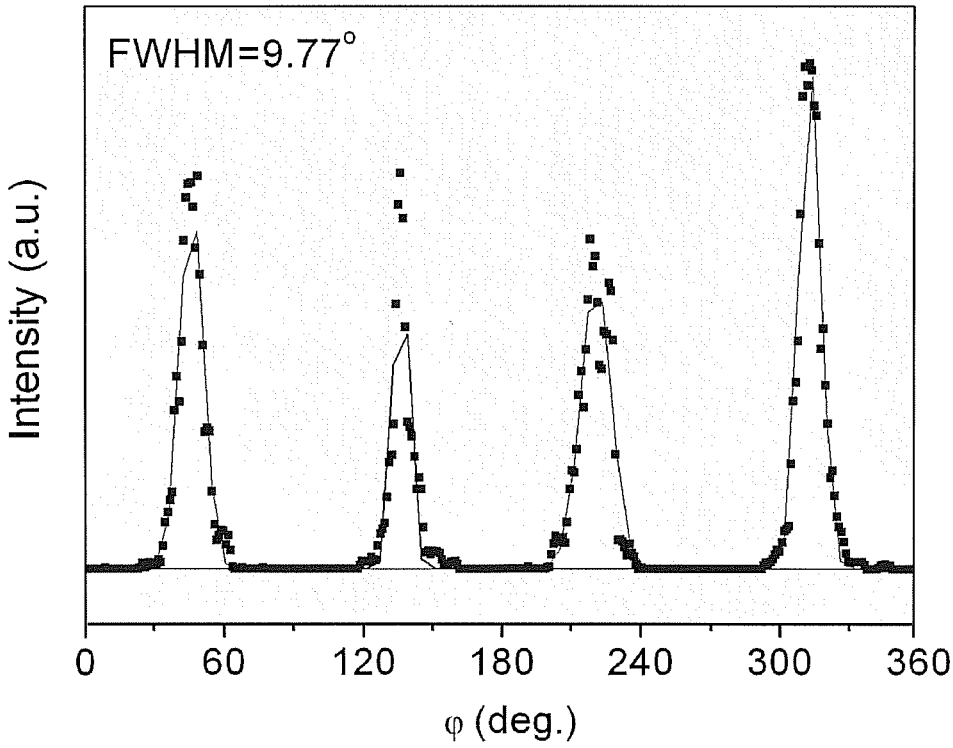
FIG. 13 shows a ϕ scan of the 111 reflection for the outer layer of a Ni7W/Ni10W/Ni13W/Ni10W/Ni7W composite substrate.

FIG. 13 shows a ϕ scan of the (111) reflection, with ϕ varying from 0° to 360°, for the outer layer of a Ni7W/Ni10W/Ni13W/Ni10W/Ni7W composite substrate. The FWHM of the ϕ-scan, as determined by fitting a Gaussian curve to one of the peaks is 9.77°. The FWHM of the peaks in this scan is indicative of the in-plane texture of the grains in the sample. The composite substrate exhibits high yield strength in which the value of $\sigma_{0.2}$ is 380 MPa, being a factor of about 9.5 and 2.5 compared to that of pure Ni and Ni5W tapes, respectively.

TABLE 2

Summary of the yield strength values of the composite substrate

| | EXAMPLE | | | | |
|---|---|---|---|---|---|
| | VI | VII | VIII | IX | X |
| Yield strength of the composite substrate at room temperature/MPa | 181 | 405 | 285 | 338 | 380 |
| Multiple when compared with the pure Ni substrate | 4.5 | 10.1 | 7.1 | 8.4 | 9.5 |
| Multiple when compared with the pure Ni5W substrate | 1.2 | 2.7 | 1.9 | 2.3 | 2.5 |

TABLE 2-continued

| Summary of the yield strength values of the composite substrate | | | | | |
|---|---|---|---|---|---|
| | EXAMPLE | | | | |
| | VI | VII | VIII | IX | X |
| Yield strength of the pure Ni substrate/MPa | | | 40 | | |
| Yield strength of the single Ni5W substrate/MPa | | | 150 | | |

What is claimed is:

1. A method of preparing a biaxially textured composite article comprising the steps of:

a) preparing a preformed composite ingot of a multilayer structure of a composite substrate with an outer layer being a Ni—W alloy and an inner layer being a Ni—W alloy, the W content of the outer layer being lower than the W content of the inner layer;

b) sintering the preformed composite ingot to form a metal alloy composite ingot;

c) rolling the metal alloy composite ingot to form a cold-rolled composite substrate; and d) annealing the cold-rolled composite substrate to form the biaxially textured composite article with high mechanical strength and reduced magnetization, said multilayer structure of the composite substrate having at least three layers, one or more inner layer being a Ni—W alloy with 9-13% W, and two outer layers being a Ni—W alloy with 3-9% W, with the content of W gradually decreasing from the inner layer to the outer layers;

characterized in that the preformed composite ingot is prepared by filling and compacting Ni—W mixed powders into a mould layer by layer according to the multilayer structure of the composite substrate;

in said mould, said preformed composite ingot having a total thickness of 5-250 mm, the thickness of the two outer layers being ⅔-⅔ of the total thickness.

2. A method of preparing a biaxially textured composite article comprising the steps of:

preparing a composite preform having an outer layer and an inner layer, by filling and compacting Ni—W powders in a mould layer by layer, wherein the outer layer is filled with outer-layer Ni—W powders, the inner layer is filled with inner-layer Ni—W powders having a W content higher than that of the outer-layer Ni—W powders, so that the W content of the outer layer is lower than the W content of the inner layer;

sintering the composite preform to form a sintered composite preform, wherein a diffusion layer is formed at an interface between the outer layer and the inner layer and the W content in the diffusion layer gradually decreases from the inner layer side to the outer layer side;

rolling the sintered composite preform to form a cold-rolled composite preform; and annealing the cold-rolled composite preform to form the biaxially textured composite article.

3. The method according to claim 1, wherein said rolling has a per pass reduction of 5-20% and a total reduction of more than 90%.

4. The method according to claim 1, wherein said annealing is carried out in a flowing gas containing $H_2$ at a temperature in the range of 600° C. to 800° C. for 15-120 minutes, followed by annealing at a temperature in the range of 900° C. to 1350° C. for 30-180 minutes.

5. The method according to claim 1, wherein said sintering is accomplished by powder metallurgy technique or by sparking plasma sintering technique.

6. The method according to claim 5, A wherein said sintering is carried out in a flowing gas containing $H_2$ at a temperature in the range of 800° C. to 1100° C. for 20-60 minutes for the preformed composite ingot prepared by the sparking plasma sintering technique in a vacuum.

7. The method according to claim 1, wherein said annealing is carried out at a temperature in the range of 900° C. to 1350° C. for 30-180 minutes.

8. The method according to claim 1, wherein during sintering the preformed composite ingot, a diffusion layer is formed at an interface between the outer layer and the inner layer and the W content in the diffusion layer gradually decreases from the inner layer side to the outer layer side.

9. The method according to claim 5, wherein said sintering is carried out in a flowing gas containing $H_2$ at a temperatures in the range of 900° C. to 1350° C. for 5-10 hours for the preformed composite ingot prepared by the powder metallurgy technique.

10. The method according to claim 2, wherein said sintering is carried out by powder metallurgy technique in a flowing gas containing $H_2$ at a temperatures in the range of 900° C. to 1350° for 5-10 hours.

11. The method according to claim 2, wherein said sintering is carried out by sparking plasma sintering technique in a flowing gas containing $H_2$ at a temperature in the range of 800° C. to 1100° C. for 20-60 minutes in a vacuum.

12. The method according to claim 2, wherein said composite preform comprises two outer layers being a Ni—W alloy with 3-9% W, and one or more inner layers being a Ni—W alloy with 9-13% W sandwiched between the two outer layers.

13. The method according to claim 12, wherein said composite preform has a total thickness of 5-250 mm, and the thickness of the two outer layers is ⅔-⅔ of the total thickness.

14. The method according to claim 12, wherein said composite preform comprises three inner layers with one inner layer in the middle sandwiched between two other inner layers, and the inner layer in the middle has a W content higher than that of the other two inner layers.

* * * * *